US009586777B2

(12) United States Patent
Izumichi

(10) Patent No.: US 9,586,777 B2
(45) Date of Patent: Mar. 7, 2017

(54) SHEET CONVEYING DEVICE AND IMAGE FORMING APPARATUS INCLUDING THE SAME

(71) Applicant: KYOCERA Document Solutions Inc., Osaka (JP)

(72) Inventor: Sachio Izumichi, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 0 days.

(21) Appl. No.: 15/047,101

(22) Filed: Feb. 18, 2016

(65) Prior Publication Data

US 2016/0251181 A1 Sep. 1, 2016

(30) Foreign Application Priority Data

Feb. 26, 2015 (JP) ..... 2015-036084

(51) Int. Cl.
*B65H 5/00* (2006.01)
*B65H 5/36* (2006.01)
(Continued)

(52) U.S. Cl.
CPC ..... *B65H 5/36* (2013.01); *B65H 5/062* (2013.01); *B65H 29/125* (2013.01);
(Continued)

(58) Field of Classification Search
CPC ..... B65H 2301/3331; B65H 29/58
See application file for complete search history.

(56) References Cited

U.S. PATENT DOCUMENTS 6,533,271 B1 * 3/2003 Zimmermann ..... B65H 29/58 271/303
8,434,755 B2 * 5/2013 Imai ..... B65H 5/062 271/225
(Continued)

FOREIGN PATENT DOCUMENTS

JP 2003-267610 A 9/2003
JP 2004-331387 A 11/2004
(Continued)

OTHER PUBLICATIONS

Japanese Office Action dated Aug. 3, 2016, issued to Japanese Application No. 2015-036084.

*Primary Examiner* — Howard Sanders
(74) *Attorney, Agent, or Firm* — Stein IP, LLC

(57) ABSTRACT

A sheet conveying device includes a switchback unit, a first conveying path, a second conveying path, a switching member, and a convey roller. The first conveying path conveys a sheet to the switchback unit. The second conveying path receives the sheet after the conveying direction is switched by the switchback unit. The switching member rotates about a rotation fulcrum axis extending in a sheet width direction so as to switch between a first attitude for guiding the sheet from the first conveying path to the switchback unit and a second attitude for guiding the sheet from the switchback unit to the second conveying path. The convey roller includes a rotation shaft disposed on the same axis as the rotation fulcrum axis of the switching member and has an outer circumference surface protruding more than a sheet guiding surface of the switching member.

8 Claims, 9 Drawing Sheets

(51) Int. Cl.

| | |
|---|---|
| ***G03G 15/00*** | (2006.01) |
| ***B65H 5/06*** | (2006.01) |
| ***G03G 15/23*** | (2006.01) |
| ***B65H 29/58*** | (2006.01) |
| ***B65H 85/00*** | (2006.01) |
| ***B65H 29/12*** | (2006.01) |
| ***B65H 31/24*** | (2006.01) |

(52) U.S. Cl.

CPC ..... *B65H 29/58* (2013.01); *B65H 31/24* (2013.01); *B65H 85/00* (2013.01); *G03G 15/234* (2013.01); *G03G 15/6529* (2013.01); *B65H 2301/3331* (2013.01); *B65H 2301/33312* (2013.01); *B65H 2402/5152* (2013.01); *B65H 2404/1521* (2013.01); *B65H 2404/513* (2013.01); *B65H 2404/54* (2013.01); *B65H 2404/6111* (2013.01); *B65H 2404/63* (2013.01); *B65H 2405/3311* (2013.01); *B65H 2601/324* (2013.01); *B65H 2801/06* (2013.01); *G03G 2215/00675* (2013.01)

(56) References Cited

U.S. PATENT DOCUMENTS

| | | | | |
|---|---|---|---|---|
| 2003/0175060 | A1 | 9/2003 | Suzuki | 399/401 |
| 2009/0108517 | A1* | 4/2009 | Guerand | B65H 29/58 271/225 |

FOREIGN PATENT DOCUMENTS

| | | | |
|---|---|---|---|
| JP | 2004-345844 | A | 12/2004 |
| JP | 2006-082948 | A | 3/2006 |
| JP | 2008-273648 | A | 11/2008 |

* cited by examiner

SHEET CONVEYING DEVICE AND IMAGE FORMING APPARATUS INCLUDING THE SAME

INCORPORATION BY REFERENCE

This application is based upon and claims the benefit of priority from the corresponding Japanese Patent Application No. 2015-036084 filed Feb. 26, 2015, the entire contents of which are hereby incorporated by reference.

BACKGROUND

The present disclosure relates to a sheet conveying device for conveying sheets, and to an image forming apparatus including the sheet conveying device.

Conventionally, in an image forming apparatus for forming an image on a sheet, a toner image is formed on a photosensitive drum, and the toner image is transferred onto a sheet in a transfer nip between the photosensitive drum and a transfer roller. The image forming apparatus further includes a fixing unit, and the sheet with the transferred toner image undergoes the fixing process in the fixing unit and then is discharged. The image forming apparatus includes a sheet conveying device for conveying the sheet to the transfer nip or from the transfer nip.

For instance, there is known a sheet conveying device including a rotatable flapper for switching a conveying direction of the sheet after the fixing process. In addition, the flapper is provided with a rotatable roller. The roller reduces friction between the flapper and the sheet.

SUMMARY

A sheet conveying device according to an aspect of the present disclosure includes a switchback unit, a first conveying path, a second conveying path, a switching member, and a convey roller. The switchback unit switches a sheet conveying direction. The first conveying path conveys a sheet to the switchback unit. The second conveying path conveys a sheet after the conveying direction is switched by the switchback unit. The switching member is disposed between the first conveying path and the switchback unit, has a rotation fulcrum axis extending in a sheet width direction crossing the sheet conveying direction, and rotates about the rotation fulcrum axis so as to switch between a first attitude for guiding a sheet from the first conveying path to the switchback unit and a second attitude for guiding a sheet from the switchback unit to the second conveying path. The convey roller includes a rotation shaft disposed on the same axis as the rotation fulcrum axis of the switching member, and an outer circumference surface of the convey roller protrudes more than a sheet guiding surface of the switching member.

Further features and advantages of the present disclosure will become apparent from the description of embodiments given below.

DETAILED DESCRIPTION

Figure 1:
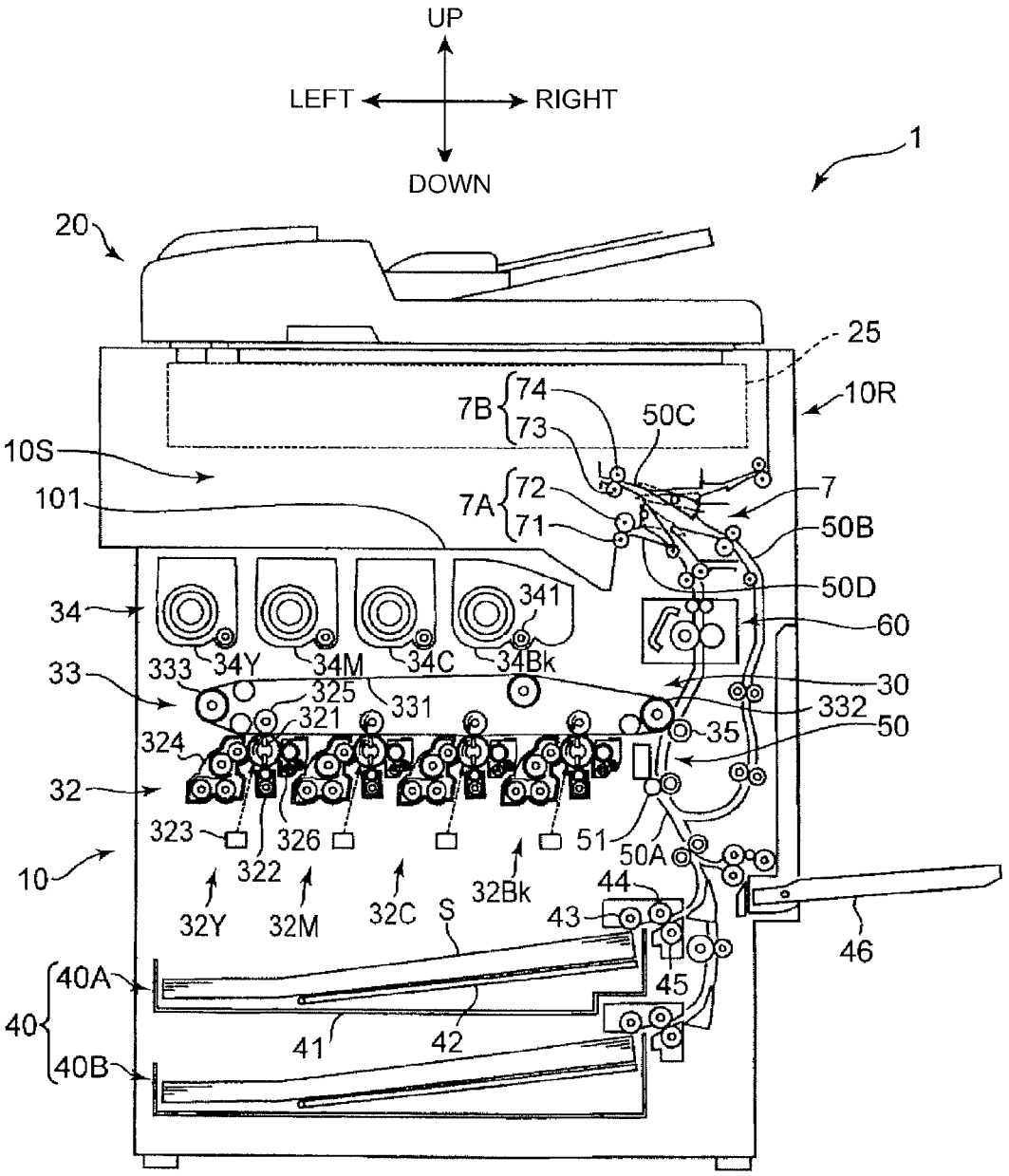
FIG. 1 is a cross-sectional view illustrating an internal structure of an image forming apparatus including a sheet conveying device according to the present disclosure.

Now, with reference to the drawings, an embodiment of the present disclosure is described. FIG. 1 is a cross-sectional view illustrating an internal structure of an image forming apparatus 1 according to an embodiment of the present disclosure. In this description, a multifunction peripheral having a printer function and a copier function is exemplified as the image forming apparatus 1, but the image forming apparatus may be a printer, a copier, or a facsimile apparatus.

<Description of Image Forming Apparatus>

The image forming apparatus 1 includes an apparatus main body 10 having a cabinet structure of a substantially rectangular parallelepiped shape, and an automatic document feeder (hereinafter referred to as an ADF) 20 disposed on the upper side of the apparatus main body 10. Inside the apparatus main body 10, there are disposed a reader unit 25 for optically reading a document image to be copied, an image forming unit 30 for forming a toner image on a sheet, a fixing unit 60 for fixing the toner image onto the sheet, a sheet feeding unit 40 for storing sheets to be conveyed to the image forming unit 30, and a conveying path 50 for conveying the sheet from the sheet feeding unit 40 or a sheet feeding tray 46 to a discharge space 10S via the image forming unit 30 and the fixing unit 60. The sheets S discharged to the discharge space 10S are stacked on a discharge portion 101.

The ADF 20 automatically feeds document sheets to be copied to a predetermined document read position on the apparatus main body 10. On the other hand, when a user places a document sheet manually on a predetermined document read position, the ADF 20 is lifted upward to open. The reader unit 25 optically reads an image of a document sheet fed automatically from the ADF 20 on the upper surface of the apparatus main body 10 or reads an image of a document sheet placed manually.

The image forming unit 30 generates a full color toner image and transfers the full color toner image onto a sheet so that the image is formed on the sheet. The image forming unit 30 includes an image forming unit 32 including four units 32Y, 32M, 32C and 32Bk arranged in tandem for forming yellow (Y), magenta (M), cyan (C) and black (Bk)

toner images, and an intermediate transfer unit 33 disposed adjacent to the upper side of the image forming unit 32, and a toner supply unit 34 disposed above the intermediate transfer unit 33.

Each of the image forming units 32Y, 32M, 32C and 32Bk includes a photosensitive drum 321, and also includes a charger 322, an exposing unit 323, a developing unit 324, a primary transfer roller 325, and a cleaning device 326 disposed around the photosensitive drum 321.

The photosensitive drum 321 rotates about the rotation shaft, and an electrostatic latent image and a toner image are formed on an outer circumference surface of the photosensitive drum 321. The charger 322 uniformly charges a photosensitive layer formed on the outer circumference surface of the photosensitive drum 321. The exposing unit 323 includes a laser light source and optical system elements such as a mirror and a lens, and irradiates the outer circumference surface of the photosensitive drum 321 with light based on image data of the document image so as to form the electrostatic latent image.

The developing unit 324 supplies toner to the circumference surface of the photosensitive drum 321 so as to develop the electrostatic latent image formed on the photosensitive drum 321. The primary transfer roller 325 primarily transfers the toner image on the photosensitive drum 321 onto an intermediate transfer belt 331. The cleaning device 326 cleans toner remaining on the outer circumference surface of the photosensitive drum 321 after the transfer of the toner image.

The intermediate transfer unit 33 includes the intermediate transfer belt 331, a belt drive roller 332, and a follower roller 333. A plurality of toner images are transferred from the photosensitive drums 321 to the outer circumference surface of the intermediate transfer belt 331 so as to be overlaid at the same position. The intermediate transfer belt 331 turns in a counterclockwise direction in FIG. 1.

A secondary transfer roller 35 is disposed to face the circumference surface of the belt drive roller 332. A nip between the belt drive roller 332 and the secondary transfer roller 35 becomes a secondary transfer portion for transferring the full color toner image primarily transferred and overlaid on the intermediate transfer belt 331 onto the sheet.

The toner supply unit 34 includes a yellow toner container 34Y, a magenta toner container 34M, a cyan toner container 34C, and a black toner container 34Bk. The toner supply unit 34 supplies each color toner to corresponding each of developing units 324 of the image forming units 32Y, 32M, 32C and 32Bk via a supply passage (not shown).

The sheet feeding unit 40 includes two sheet feed cassettes 40A and 40B storing the sheets S on which an image is formed. These sheet feed cassettes 40A and 40B can be drawn out from the front side of the apparatus main body 10.

The sheet feed cassette 40A (40B) includes a sheet storing portion 41 for storing a stack of the sheets S, and a lift plate 42 configured to lift up the sheets for supplying the sheets. A pickup roller 43 and a roller pair consisting of a sheet feed roller 44 and a retard roller 45 are disposed on the upper right end of the sheet feed cassette 40A (40B). When the pickup roller 43 and the sheet feed roller 44 are driven, the uppermost sheet S of the stack of sheets in the sheet feed cassette 40A is sent out one by one and is conveyed to an upstream end of the conveying path 50.

The conveying path 50 includes a main conveying path 50A (a first conveying path), a reverse conveying path 50B (a second conveying path), an upper conveying path 50C (a switchback unit), and a lower conveying path 50D. The main conveying path 50A conveys the sheet S from the sheet feeding unit 40 via the image forming unit 30 to an outlet of the fixing unit 60. The reverse conveying path 50B conveys back the sheet after printing on one side to the image forming unit 30 when duplex printing is performed on the sheet S. The upper conveying path 50C conveys the sheet S from a downstream end of the main conveying path 50A toward the discharge space 10S.

In the main conveying path 50A, a registration roller pair 51 is disposed on an upstream side in the conveying direction (an upper side in FIG. 1) of a secondary transfer portion 35A. The sheet S is temporarily stopped by the registration roller pair 51 in a standstill state so that a skew correction is performed. After that, when the registration roller pair 51 is driven to rotate by a drive motor (not shown) at a predetermined timing for image transferring, the sheet S is sent out to the secondary transfer roller 35.

The fixing unit 60 is an induction heating type fixing device that performs a fixing process for fixing the toner image onto the sheet S, and a fixing nip is formed inside the fixing unit 60. When the sheet S passes through the fixing nip, the transferred toner image on the sheet S is fixed onto the sheet.

Figure 2A:
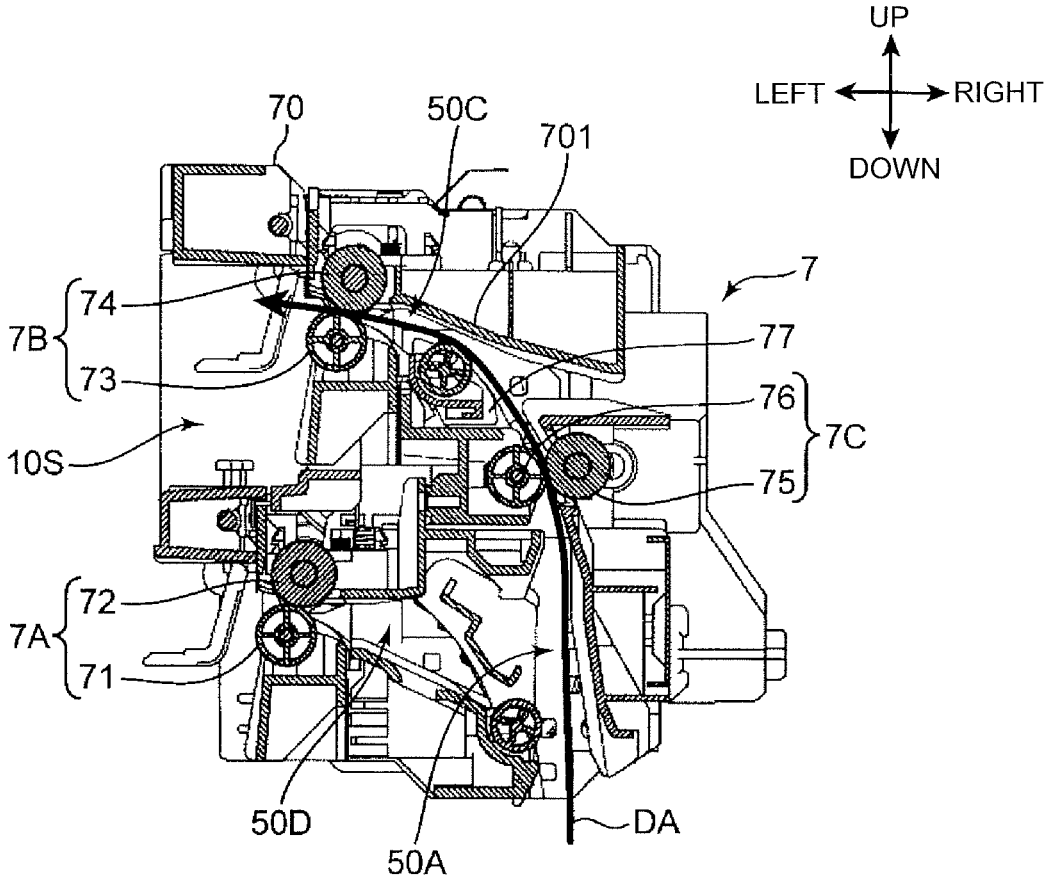
FIG. 2A is a cross-sectional view of the sheet conveying device according to an embodiment of the present disclosure and is a diagram illustrating a state where a switching guide is in a first attitude.
Figure 2B:
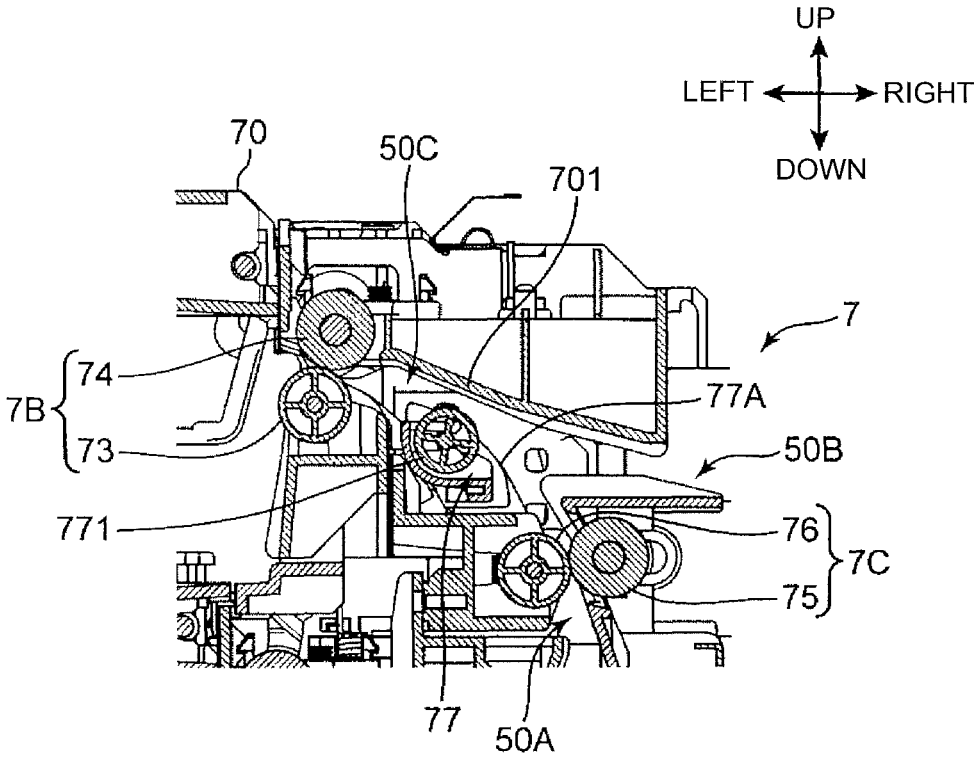
FIG. 2B is an enlarged cross-sectional view of the switching guide and its periphery in the sheet conveying device illustrated in FIG. 2A.
Figure 3A:
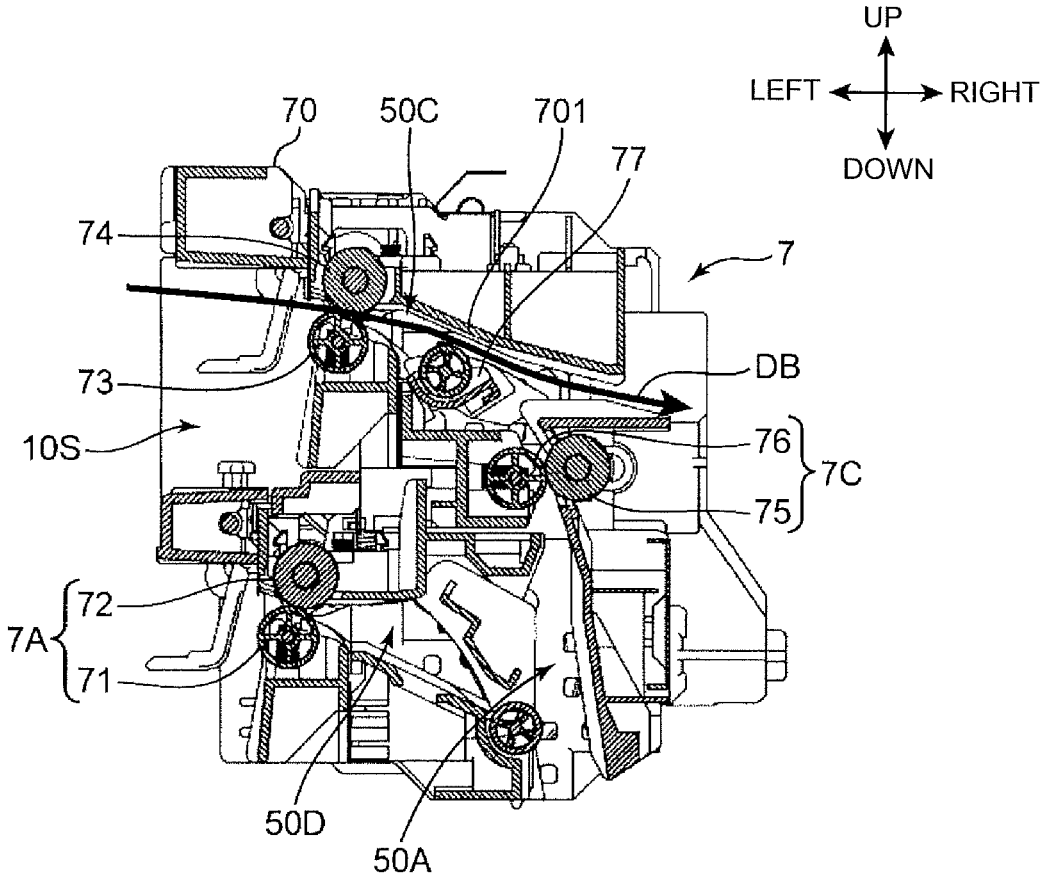
FIG. 3A is a cross-sectional view of the sheet conveying device according to an embodiment of the present disclosure and is a diagram illustrating a state where the switching guide is in a second attitude.
Figure 3B:
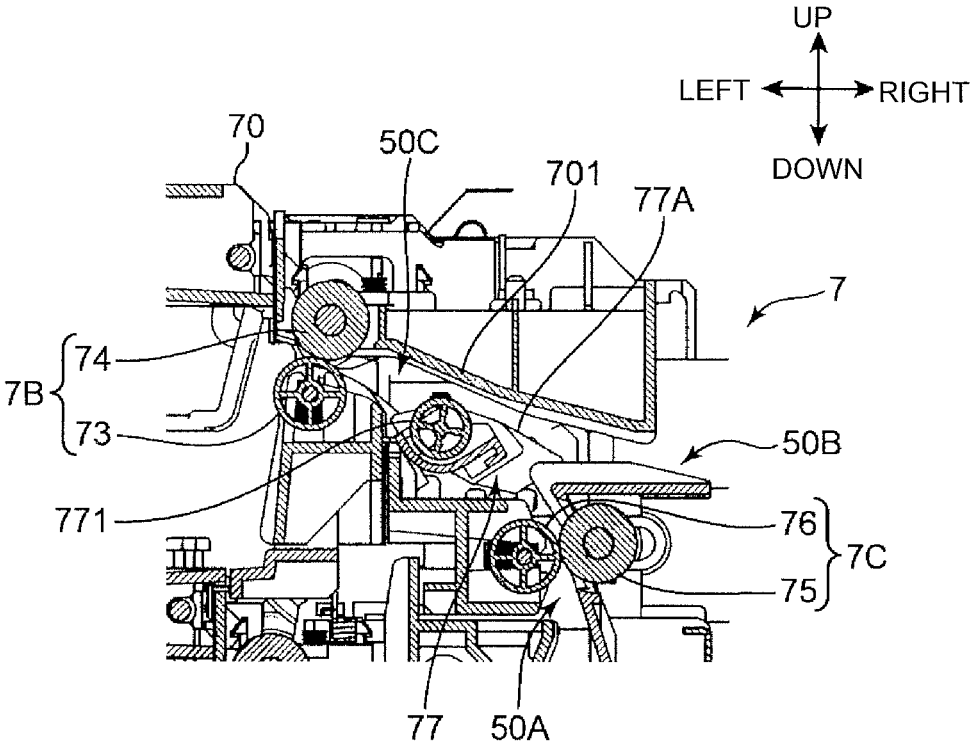
FIG. 3B is an enlarged cross-sectional view of the switching guide and its periphery in the sheet conveying device illustrated in FIG. 3A.

Further, the image forming apparatus 1 includes a conveying unit 7 (a sheet conveying device). As illustrated in FIG. 1, the conveying unit 7 is disposed above the fixing unit 60. The conveying unit 7 has a function of conveying the sheet S after the fixing process performed by the fixing unit 60 toward the discharge space 10S or the reverse conveying path 50B. Next, with reference to FIGS. 2A to 3B, the conveying unit 7 is further described in detail. FIG. 2A is a cross-sectional view of the conveying unit 7 according to this embodiment, and FIG. 2B is an enlarged cross-sectional view in which a part of the conveying unit 7 illustrated in FIG. 2A is enlarged. In the same manner, FIG. 3A is a cross-sectional view of the conveying unit 7 according to this embodiment, and FIG. 3B is an enlarged cross-sectional view in which a part of the conveying unit 7 illustrated in FIG. 3A is enlarged. Note that FIGS. 2A and 2B illustrate a state where a switching guide 77 described later is in a first attitude, while FIGS. 3A and 3B illustrate a state where the switching guide 77 is in a second attitude. Inside the conveying unit 7, in addition to a downstream side part of the main conveying path 50A and an upstream side part of the reverse conveying path 50B, the upper conveying path 50C and the lower conveying path 50D are formed.

With reference to FIG. 2A, the conveying unit 7 includes a unit housing 70, a first discharge roller pair 7A, a second discharge roller pair 7B (a second conveying roller pair), a conveying roller pair 7C (a first conveying roller pair), and a switching guide 77 (switching member).

The unit housing 70 is a chassis of the conveying unit 7. As illustrated in FIG. 2A, the downstream side part of the main conveying path 50A extends vertically inside the unit housing 70. The upper conveying path 50C (the switchback unit) is a conveying path communicated to the upper end of the main conveying path 50A. The sheet S is conveyed in a curved state along the conveying direction from the lower right to the upper left of the upper conveying path 50C. In addition, as described later, when duplex printing is performed on the sheet S, switchback of the sheet S is performed in the upper conveying path 50C. The lower conveying path 50D is communicated to the main conveying path 50A at a position below the upper conveying path 50C. Note that the conveying direction of the sheet S is switched between the upper conveying path 50C side and the lower conveying path 50D side by a guide member (not shown).

The first discharge roller pair 7A is disposed at a downstream side end in the conveying direction (a left end in FIG. 2A) of the lower conveying path 50D. When the first discharge roller pair 7A is driven to rotate so as to discharge the sheet S to the discharge space 10S. The first discharge roller pair 7A includes a first follower roller 71 and a first discharge roller 72. When the first discharge roller 72 is driven to rotate by a drive unit (not shown), the first follower roller 71 rotates to follow the first discharge roller 72.

The second discharge roller pair 7B is disposed at a downstream side end in the conveying direction (a left end in FIG. 2A) of the upper conveying path 50C. The second discharge roller pair 7B includes a second follower roller 73 and a second discharge roller 74. When the second discharge roller 74 is driven to rotate by a drive unit (not shown), the second follower roller 73 rotates to follow the second discharge roller 74. Note that a rotation direction of the second discharge roller 74 of the second discharge roller pair 7B can be switched by a control unit (not shown). When the second discharge roller pair 7B rotates in a first rotation direction, the sheet S is discharged to the discharge space 10S and is stacked on the discharge portion 101. In FIG. 2A the first rotation direction of the second discharge roller 74 is a clockwise direction, and the first rotation direction of the second follower roller 73 is a counterclockwise direction. On the other hand, when the second discharge roller pair 7B is driven to rotate in a second rotation direction opposite to the first rotation direction, switchback of the sheet S sandwiched between the second discharge roller pair 7B is performed so that the sheet S is conveyed into the reverse conveying path 50B (FIG. 3B). In FIG. 3A, the second rotation direction of the second discharge roller 74 is the counterclockwise direction, while the second rotation direction of the second follower roller 73 is the clockwise direction.

The conveying roller pair 7C is disposed at a downstream side end of the main conveying path 50A, namely in a vicinity of a boundary between the main conveying path 50A and the upper conveying path 50C. The conveying roller pair 7C is driven to rotate so as to convey the sheet S in the main conveying path 50A to the upper conveying path 50C. The conveying roller pair 7C includes a conveying roller 75 and a third follower roller 76. When the conveying roller 75 is driven to rotate by a drive unit (not shown), the third follower roller 76 rotates to follow the conveying roller 75. Note that the second discharge roller pair 7B is disposed on the downstream side of the conveying roller pair 7C in the conveying direction of the sheet S. The conveying roller pair 7C and the second discharge roller pair 7B are driven to rotate at the same circumferential speed, which is a little higher than that of a conveying roller pair (not shown) of the fixing unit 60 for discharging the sheet S from the fixing unit 60 on the upstream side of the conveying roller pair 7C in the conveying direction.

As illustrated in FIG. 2B, the upstream side part of the reverse conveying path 50B (the second conveying path) is communicated to the upper conveying path 50C at a position between the second discharge roller pair 7B and the conveying roller pair 7C. The reverse conveying path 50B functions as a duplex conveying path for conveying the sheet S after forming an image on one side to the upstream side of the image forming unit 30 in the conveying direction again in a state where front and back surfaces of the sheet S are reversed (see FIG. 1).

Note that the unit housing 70 has a unit guide surface 701. The unit guide surface 701 extends inside the unit housing 70. The unit guide surface 701 guides the front end of the sheet S conveyed upward by the conveying roller pair 7C toward the second discharge roller pair 7B. In addition, the unit guide surface 701 guides the sheet S after the switchback by the second discharge roller pair 7B toward the reverse conveying path 50B. Accordingly, as illustrated in FIGS. 2B and 3B, the unit guide surface 701 has a slope inclined from the upper left toward the lower right of the unit housing 70.

The switching guide 77 is disposed between the main conveying path 50A and the upper conveying path 50C. The switching guide 77 includes a shaft 772 (a rotation fulcrum axis, see FIG. 4) extending in a sheet width direction (a front and rear direction) extending in a direction crossing the conveying direction of the sheet S. The switching guide 77 is rotated about the shaft 772 by a drive unit such as a solenoid so as to switch between the first attitude and the second attitude. When the switching guide 77 is in the first attitude (FIGS. 2A and 2B), the switching guide 77 guides the sheet S from the main conveying path 50A to the upper conveying path 50C (see an arrow line DA in FIG. 2A). In addition, when the switching guide 77 is in the second attitude (FIGS. 3A and 3B), the switching guide 77 guides the sheet S from the upper conveying path 50C to the reverse conveying path 50B (see an arrow line DB in FIG. 3A).

Figure 4:
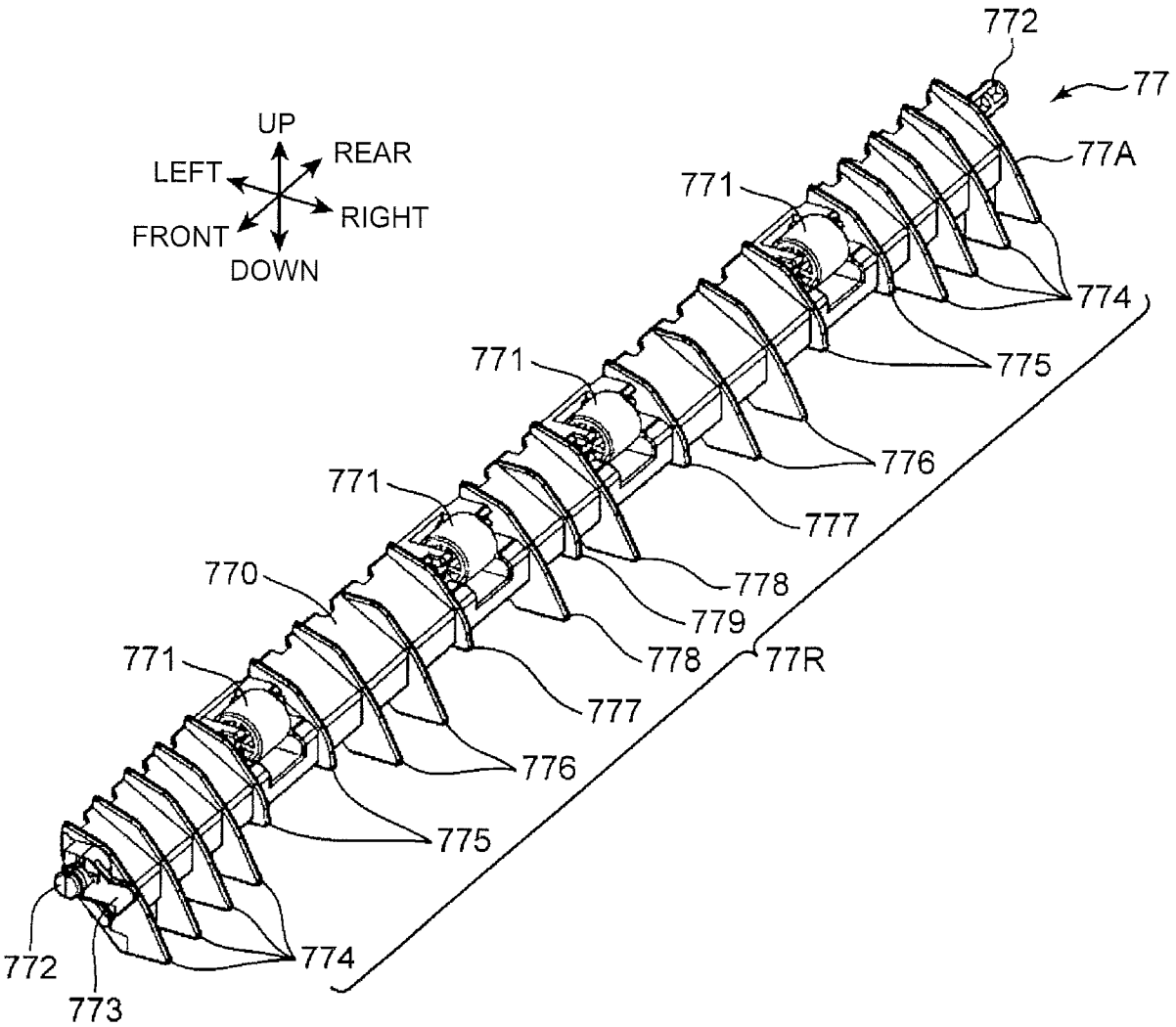
FIG. 4 is a perspective view of the switching guide used in the sheet conveying device of this embodiment.
Figure 5:
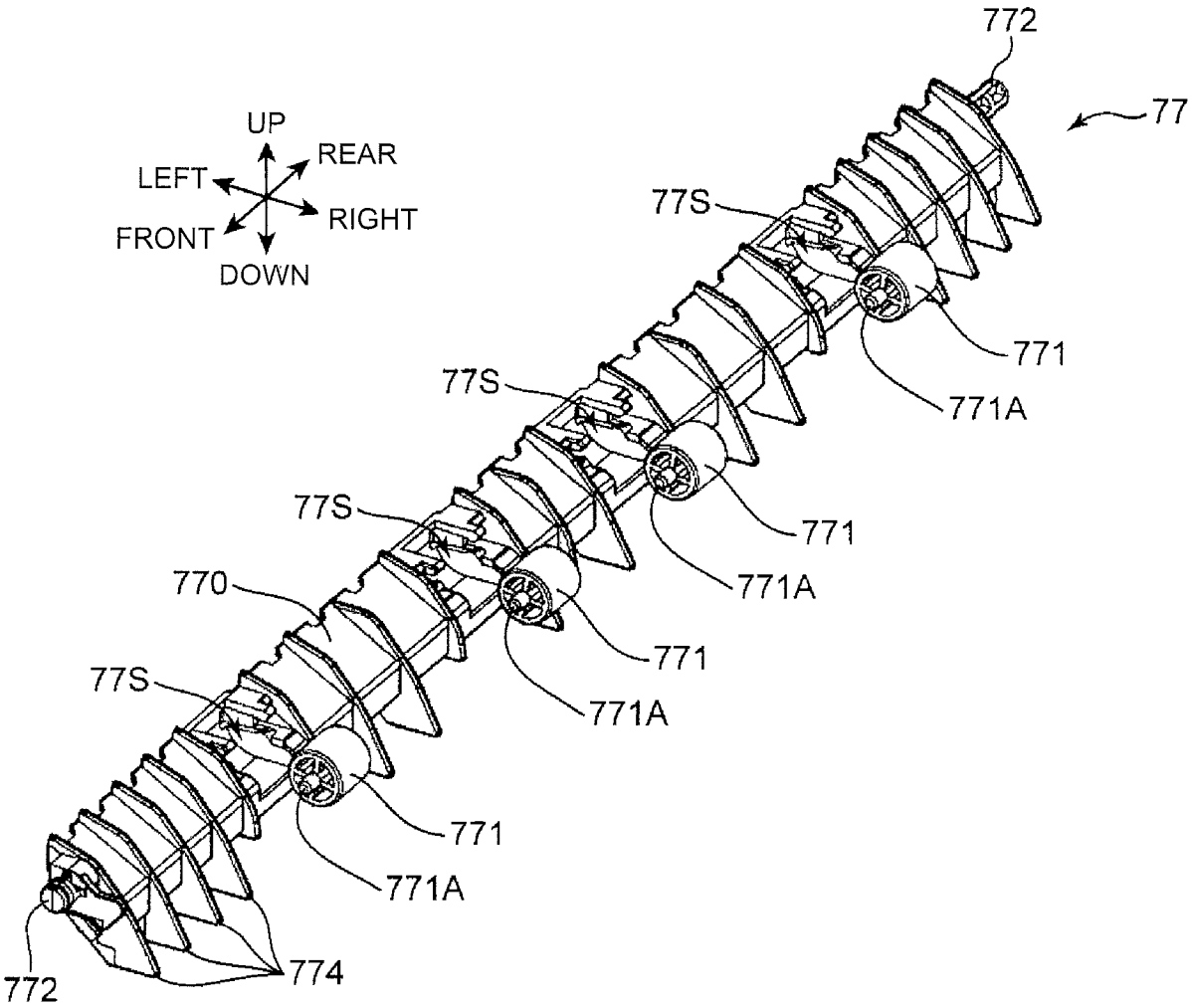
FIG. 5 is an exploded perspective view of the switching guide used in the sheet conveying device of this embodiment.
Figure 6A:
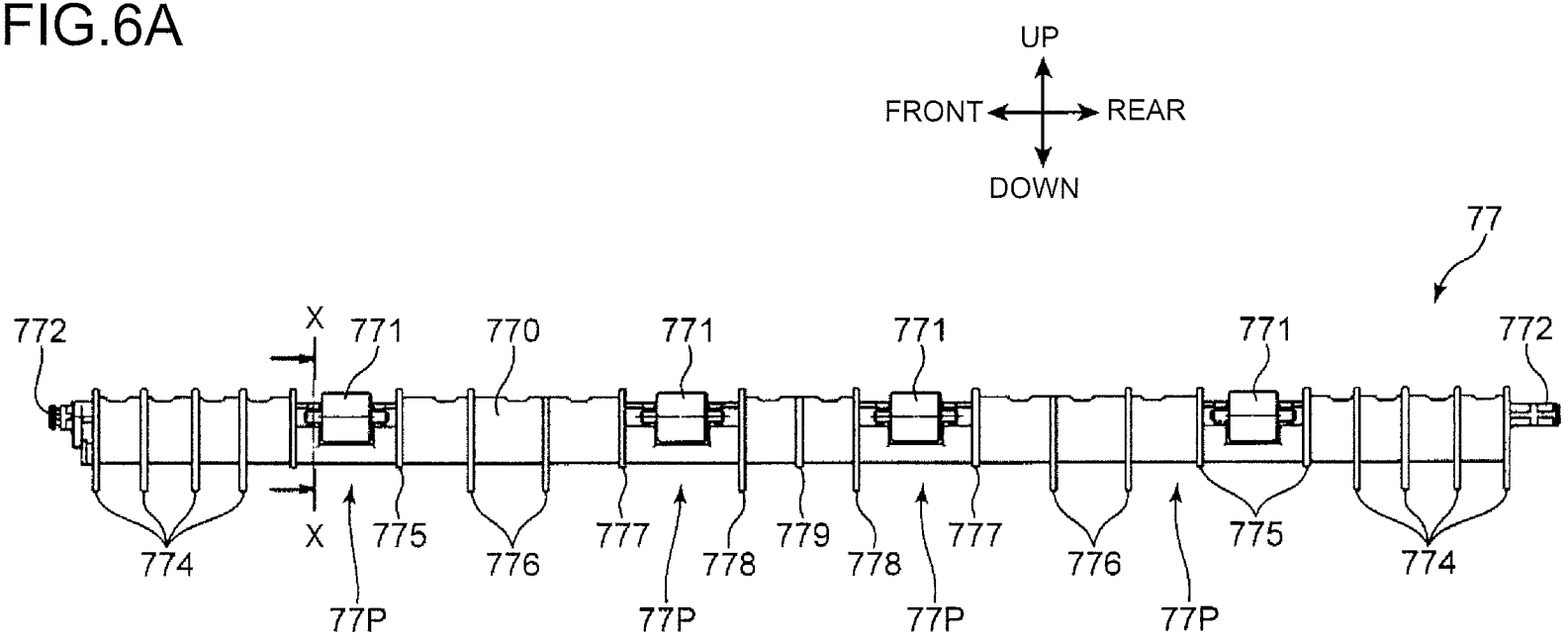
FIG. 6A is a side view of the switching guide used in the sheet conveying device of this embodiment.
Figure 6B:
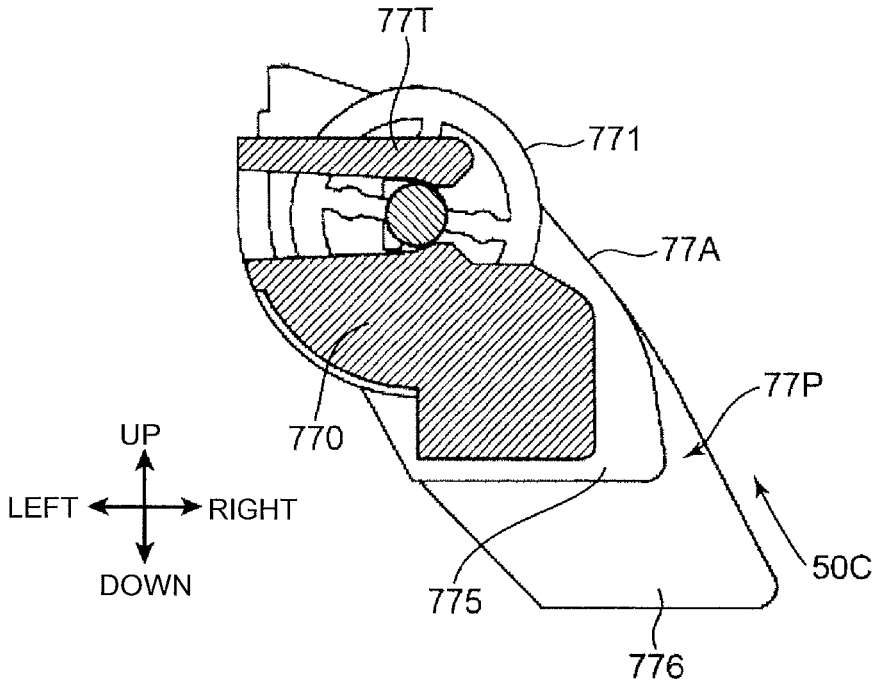
FIG. 6B is a side cross-sectional view of the switching guide used in the sheet conveying device of this embodiment.
Figure 6C:
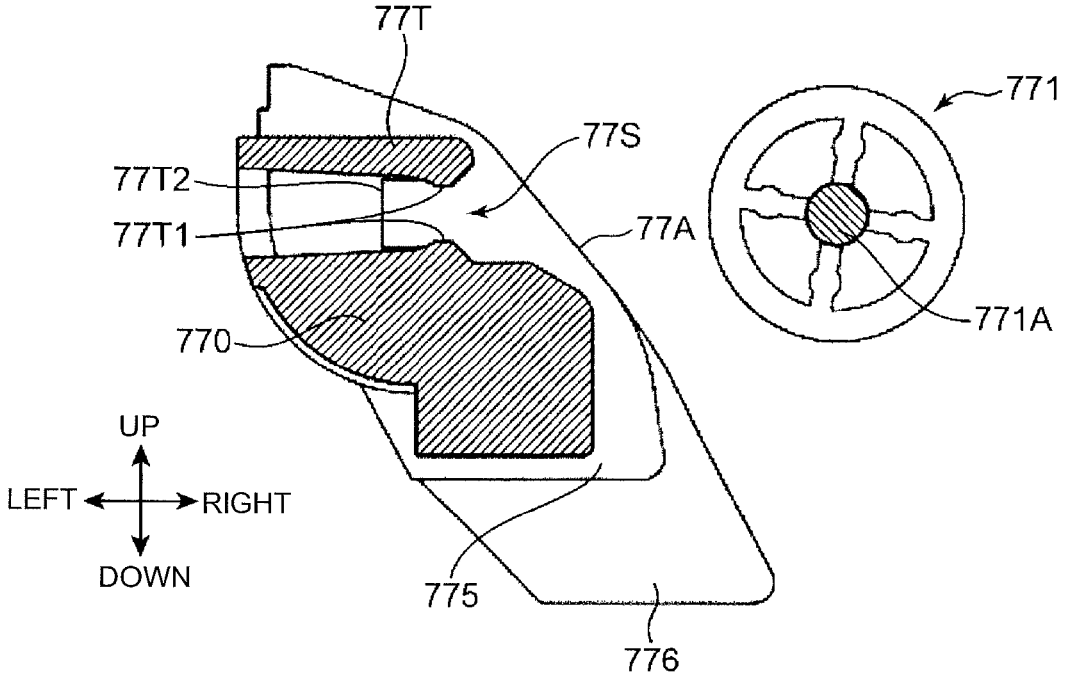
FIG. 6C is an exploded cross-sectional view illustrating a state where a convey roller is detached from the switching guide illustrated in FIG. 6B.

Next, with reference to FIGS. 4 to 6C, the switching guide 77 according to this embodiment is further described in detail. FIG. 4 is a perspective view of the switching guide 77. FIG. 5 is an exploded perspective view of the switching guide 77. FIG. 5 illustrates a state where convey rollers 771 are detached from the switching guide 77 illustrated in FIG. 4. FIG. 6A is a side view from the left of the switching guide 77. FIG. 6B is a cross-sectional view of the switching guide 77 taken along an X-X line in FIG. 6A. FIG. 6C is an exploded cross-sectional view of the switching guide 77. FIG. 6C illustrates a state where the convey roller 771 is detached rightward from the switching guide 77 compared with the cross-sectional view illustrated in FIG. 6B.

The switching guide 77 includes a guide base 770 (a main body part), guide ribs 77R (ribs), and convey rollers 771. The switching guide 77 except the convey rollers 771 is integrally molded using a resin material. The guide base 770 is a main body part of the switching guide 77 and is a rod-like member extending in the front and rear direction. The guide base 770 is provided with the shafts 772 on both sides in the front and rear direction. In addition, the guide base 770 is provided with a protrusion 773. The protrusion 773 protrudes rightward from a proximal end of the shaft 772 on the front side. A solenoid (not shown) is linked to a distal end of the protrusion 773. When a plunger of the solenoid switches between protrusion and retraction, rotation (switch of attitude) of the switching guide 77 about the shaft 772 is controlled.

The guide ribs 77R are constituted of a plurality of ribs arranged on the guide base 770 with intervals in the front and rear direction. Specifically, the guide ribs 77R include first guide ribs 774 (second ribs), second guide ribs 775 (first ribs), third guide ribs 776 (the second ribs), fourth guide ribs 777 (the first ribs), fifth guide ribs 778 (the first ribs), and sixth guide ribs 779. These ribs protrude from the guide base 770 and extend along the conveying direction of the sheet S. With reference to FIGS. 4 and 6A, four of the first guide ribs 774 are disposed on each end side of the guide base 770 with spaces. Two pairs of the second guide ribs 775 are disposed inside the first guide ribs 774 with predetermined spaces. Further, two pairs of the third guide ribs 776 are disposed inside the second guide ribs 775 with predetermined spaces. Note that the third guide ribs 776 and the fifth guide ribs 778 have the same shape as the first guide ribs 774. Two fourth guide ribs 777 are disposed inside the third guide ribs 776 with predetermined spaces. Note that the fourth guide ribs 777 have the same shape as the second guide ribs 775. Two of the fifth guide ribs 778 are disposed inside the fourth guide ribs 777 with predetermined spaces, respectively. Further, the sixth guide rib 779 is one rib disposed between the two fifth guide ribs 778 and at the center of the guide base 770 in the front and rear direction. Edges of these ribs constitute a guide surface for guiding the sheet S (a sheet guiding surface) 77A (see FIGS. 2B, 3B and 4).

A plurality of the convey rollers 771 are arranged with spaces in the front and rear direction (the sheet width direction). The circumference surfaces of the convey rollers 771 are protruded more than the guide ribs 77R to a conveying path side (a sheet surface side of the sheet S). The convey rollers 771 rotate by friction with the sheet S so as to promote conveyance of the sheet S. In addition, the convey rollers 771 prevent the sheet S from being strongly pressed and scratched at the edges of the guide ribs 77R and being damaged. The convey roller 771 includes a rotation shaft 771A and can rotate about the rotation shaft 771A. The rotation shaft 771A is protruded from front and rear side surfaces of the convey roller 771. The rotation shaft 771A is supported in a rotatable manner by nail portions 77T1 and wall portions 77T2 described later. Further, in this embodiment, the rotation shaft 771A is integrally molded with the convey roller 771 using a resin material. In order to improve sliding property with the sheet S, the convey roller 771 is made of polyacetal (POM) resin.

In addition, the guide base 770 is provided with a mounting portion 77S (see FIGS. 5 and 6C). The convey roller 771 is mounted in the mounting portion 77S. The mounting portion 77S is formed between neighboring ribs (guide ribs 77R). The mounting portion 77S is provided with a mounting groove in which the rotation shaft 771A of the convey roller 771 is inserted and supported in a rotatable manner. Specifically, with reference to FIG. 6C, the guide base 770 includes a mounting piece 77T, the nail portions 77T1 (a support portion), and the wall portions 77T2 (the support portion). The mounting piece 77T is a protrusion protruding rightward from the left end of the guide base 770 in order to press the rotation shaft 771A of the convey roller 771. The mounting groove of the mounting portion 77S is formed between the mounting piece 77T and the upper surface of the guide base 770. In addition, a pair of the nail portions 77T1 are formed at an opening edge of the mounting groove of the mounting portion 77S. Further, when the rotation shaft 771A of the convey roller 771 is mounted in the mounting groove of the mounting portion 77S while the distal end of the mounting piece 77T is elastically deformed, the pair of nail portions 77T1 support the circumference surface of the rotation shaft 771A. In this case, a pair of the wall portions 77T2 provided to both ends of the mounting portion 77S in the front and rear direction support the circumference surface of the rotation shaft 771A at the front side. In this way, the convey roller 771 is mounted in a rotatable manner in the mounting portion 77S.

In this embodiment, when the convey roller 771 is mounted in the mounting portion 77S, as illustrated in FIG. 6B, the circumference surface of the convey roller 771 protrudes to the upper conveying path 50C side more than the guide ribs 77R (the second guide rib 775 and the third guide rib 776 in FIG. 6B). Further, the rotation shaft 771A of the convey roller 771 is disposed on the same axis as the shaft 772 of the switching guide 77 (see FIGS. 4 and 6A).

Further, with reference to FIGS. 6A and 6B, the second guide ribs 775 (the first ribs) are disposed adjacent to the convey roller 771 so as to sandwich the convey roller 771 in the front and rear direction. In addition, the fourth guide rib 777 (the first rib) is also disposed adjacent to the convey roller 771. On the other hand, the first guide ribs 774 and the third guide ribs 776 are disposed further away from the convey roller 771 than the second guide rib 775 or the fourth guide rib 777 in the front and rear direction. Further, the third guide ribs 776 extend further than the second guide ribs 775 to the upstream side in the conveying direction of the sheet S in the upper conveying path 50C (FIG. 6B).

In the cross-sectional view illustrated in FIG. 6B, a conveying direction upstream part of a rim of the second guide rib 775 facing the upper conveying path 50C is recessed from a rim of the third guide rib 776 facing the upper conveying path 50C in the direction away from the upper conveying path 50C. As a result, on the conveying direction upstream side of the second guide rib 775, there is formed a recess space 77P (FIG. 6B) between the rim of the third guide rib 776 and the rim of the second guide rib 775. In FIG. 6A, the recess space 77P is formed between the first guide rib 774 and the third guide rib 776 with respect to convey rollers 771 on the front end side and the read end side among the four convey rollers 771. In addition, with respect to the two inside convey rollers 771, the recess space 77P is formed between the third guide rib 776 and the fifth guide rib 778.

Further, in this embodiment, an arrangement of the guide ribs 77R is set in advance so that side edges (front and rear edges) of any sheet S do not pass close to the rotation shaft 771A of the convey roller 771 even if the conveying unit 7 conveys a plurality of types of the sheets S having different sizes.

With reference to FIG. 2A, when the switching guide 77 is in the first attitude, the front edge of the sheet S contacts with the unit guide surface 701 and then reaches the second discharge roller pair 7B. In this case, the sheet S is conveyed in a state stretched between the second discharge roller pair 7B and the conveying roller pair 7C. If the sheet surface of the sheet S is pressed and scratched at the guide ribs 77R of the switching guide 77, an abrasion (damage) can easily occur in the image formed on the sheet S. In this embodiment, the convey rollers 771 protrude more than the guide ribs 77R and make surface contact with the sheet S, and hence the sheet S is prevented from being strongly pressed and scratched at the guide ribs 77R.

On the other hand, when the front edge of the sheet S protrudes to the discharge space 10S and the rear end of the sheet S reaches above the switching guide 77, the switching guide 77 is switched to the second attitude (FIGS. 3A and 3B). In this state, the second discharge roller pair 7B is driven to reversely rotate, and hence the rear end of the sheet S enters the reverse conveying path 50B by the switchback. After that, the sheet S is conveyed in a state stretched between a roller pair (not shown) disposed in the reverse conveying path 50B and the second discharge roller pair 7B. Also in this case, the convey rollers 771 make surface contact with the sheet S, and hence the sheet S is prevented from being strongly pressed and scratched at the guide ribs 77R.

In any of the cases described above, the recess space 77P (FIG. 6B) is formed in a vicinity of the convey rollers 771. Accordingly, the sheet surface is contacted with the circumference surface of the convey rollers 771, and is prevented from being strongly pressed and scratched at the guide ribs 77R (the third guide ribs 776) on the upstream side (FIG. 2A) or the downstream side (FIG. 3A) in the conveying direction.

In addition, in this embodiment, the shaft 772 of the switching guide 77 to be the rotation fulcrum axis is on the same axis as the rotation shaft 771A of the convey rollers 771. Accordingly, when the switching guide 77 changes its attitude, a rotation moment generated by a weight of the convey rollers 771 is not applied to the switching guide 77. Thus, it is possible to prevent an unstable load from being applied to a drive source for switching the attitude of the switching guide 77. Accordingly, a defective rotation of the switching guide 77 can be suppressed. As a result, damage to the sheet can be suppressed, and the sheet conveying direction can be stably switched.

In addition, the convey rollers 771 do not move when the attitude of the switching guide 77 is switched, and hence a distance between the circumference surface of the convey roller 771 and the unit guide surface 701 does not change in FIGS. 2B and 3B. Accordingly, in a periphery of the switching guide 77, a minimum cross sectional area of the upper conveying path 50C does not change, and hence the sheet S can be stably conveyed. In other words, if the shaft 772 of the switching guide 77 and the rotation shaft 771A of the convey roller 771 are on different axes, a position of the circumference surface of the convey roller 771 changes when the attitude of the switching guide 77 is switched. In this case, the minimum cross sectional area of the upper conveying path 50C changes, and hence jamming of the sheet S is apt to occur. In addition, if a structure in which the unit guide surface 701 is moved in accordance with a movement of the convey rollers 771 is adopted, a complicated movement mechanism is necessary so that cost of the conveying unit 7 is increased.

Further, in this embodiment, the convey rollers 771 can be easily detached and attached to the mounting portion 77S of the switching guide 77. Accordingly, if a foreign body is in the mounting portion 77S so that a defective rotation of the convey roller 771 occurs, it is easy to perform cleaning and maintenance by detaching the convey roller 771. In addition, the guide base 770 and the guide ribs 77R of the switching guide 77, and the main body part of the convey roller 771 are made of a resin material, and hence cost of the conveying unit 7 can be lower than a case where metal shafts are used or a case where screws are used for fixing the convey rollers 771. In addition, the convey roller 771 can be exchanged separately from the switching guide 77, and hence maintenance of the conveying unit 7 can be realized in low cost.

Although the conveying unit 7 and the image forming apparatus 1 including the conveying unit 7 according to the embodiment of the present disclosure are described above, the present disclosure is not limited to the embodiment. For instance, a variation of the embodiment can be adopted as follows.

In the embodiment described above, the reverse conveying path 50B is exemplified as the second conveying path of the present disclosure, but the present disclosure is not limited to this. For instance, the second conveying path may be a conveying path for conveying the sheet S to a sheet discharge tray (not shown) disposed on a right side surface 10R of the apparatus main body 10 (FIG. 1).

According to the present disclosure, it is possible to provide the sheet conveying device and the image forming apparatus including the sheet conveying device, which can suppress occurrence of damage to the sheet and can stably switch the sheet conveying direction.

What is claimed is:

1. A sheet conveying device comprising:

a switchback unit configured to switch a sheet conveying direction;

a first conveying path for conveying a sheet to the switchback unit;

a second conveying path for conveying a sheet after the sheet conveying direction is switched by the switchback unit;

a switching member disposed between the first conveying path and the switchback unit, the switching member having a rotation fulcrum axis extending in a sheet width direction crossing the sheet conveying direction and rotating about the rotation fulcrum axis so as to switch between a first attitude for guiding a sheet from the first conveying path to the switchback unit and a second attitude for guiding a sheet from the switchback unit to the second conveying path;

a unit guide surface for guiding a sheet guided from the first conveying path to the switchback unit and for guiding a sheet guided from the switchback unit to the second conveying path;

a sheet guiding surface formed on the switching member so as to face the unit guide surface, for guiding a sheet guided from the first conveying path to the switchback unit and for guiding a sheet guided from the switchback unit to the second conveying path; and at least one convey roller including a rotation shaft disposed on the same axis as the rotation fulcrum axis of the switching member, an outer circumference surface of the convey roller protruding more than the sheet guiding surface, the at least one convey roller being disposed at a predetermined interval from the unit guide surface.

2. The sheet conveying device according to claim 1, wherein the switching member includes a main body part having the rotation fulcrum axis and a plurality of ribs arranged on the main body part with spaces in the sheet width direction, and the convey roller is disposed between the plurality of ribs and has the outer circumference surface protruding more than the sheet guiding surface formed by rims of the ribs.

3. The sheet conveying device according to claim 2, wherein the main body part of the switching member includes a support portion for supporting the rotation shaft of the convey roller in a rotatable manner, and the convey roller is detachable and attachable to the support portion.

4. The sheet conveying device according to claim 2, wherein the plurality of ribs includes one or more first ribs disposed adjacent to at least one of both sides of the convey roller in the sheet width direction, and one or more second ribs disposed further away from the convey roller than the first ribs in the sheet width direction, the second ribs extend further than the first rib to the upstream side in the sheet conveying direction in the first conveying path, and the second ribs protrude by a larger amount than the first ribs from an upstream side end of the main body part in the conveying direction.

5. The sheet conveying device according to claim 1, wherein a plurality of convey rollers are disposed with predetermined spaces in the sheet width direction.

6. The sheet conveying device according to claim 1, wherein a first conveying roller pair for conveying the sheet to the switchback unit is disposed in the first conveying path, and the switchback unit includes a second conveying roller pair, which rotates in a first rotation direction so as to convey the sheet conveyed from the first conveying roller pair in the same direction as the first conveying roller pair, and rotates in a second rotation direction opposite to the first rotation direction so as to convey the sheet to the second conveying path.

7. An image forming apparatus comprising:

the sheet conveying device according to claim 1; and an image forming unit for forming an image on a sheet, wherein the sheet conveying device conveys the sheet on which the image is formed by the image forming unit.

8. The image forming apparatus according to claim 7, further comprising a discharge portion to which the sheet on which the image is formed by the image forming unit is discharged, wherein the first conveying path conveys the sheet after passing through the image forming unit to the discharge portion, and the second conveying path is a reverse conveying path for conveying the sheet after forming an image on one side to an upstream side of the image forming unit in the sheet conveying direction of the first conveying path in a state where front and back surfaces of the sheet are reversed.

* * * * *